US008938813B2

(12) United States Patent
McDowell

(10) Patent No.: US 8,938,813 B2
(45) Date of Patent: Jan. 27, 2015

(54) TIE LOOP

(71) Applicant: Robert McDowell, Long Grove, IL (US)

(72) Inventor: Robert McDowell, Long Grove, IL (US)

( * ) Notice: Subject to any disclaimer, the term of this patent is extended or adjusted under 35 U.S.C. 154(b) by 135 days.

(21) Appl. No.: 13/625,394

(22) Filed: Sep. 24, 2012

(65) Prior Publication Data

US 2014/0082824 A1 Mar. 27, 2014

Related U.S. Application Data

(60) Provisional application No. 61/537,324, filed on Sep. 21, 2011.

(51) Int. Cl.
*A41D 25/04* (2006.01)

(52) U.S. Cl.
USPC ..... 2/157; 2/144

(58) Field of Classification Search
CPC ..... A41D 27/08; A41D 25/00; A41D 25/003; A41D 25/027; A45C 13/08; A45C 13/001; A45C 13/30; A41F 1/002; A41F 15/02; A44C 1/00; A44C 25/00; A44C 15/0045; A44B 6/00
USPC ..... 2/157, 244, 144, 145
See application file for complete search history.

(56) References Cited

U.S. PATENT DOCUMENTS 2,006,427 A * 7/1935 Wolfson ..... 2/145
2,448,611 A * 9/1948 Martin ..... 116/234
3,042,983 A 4/1959 Riedler
3,467,993 A 9/1969 Smith
3,529,328 A 9/1970 Davison
4,249,267 A * 2/1981 Voss ..... 2/69
4,920,579 A 5/1990 Swain
4,972,523 A 11/1990 Begg
5,245,708 A 9/1993 Campelia et al.
5,353,438 A 10/1994 Voiles
5,435,011 A * 7/1995 Nicolai et al. ..... 2/145
5,682,653 A 11/1997 Berglof et al.
5,715,538 A 2/1998 Soll
5,979,021 A 11/1999 Swift
6,216,275 B1 4/2001 Lee
6,401,649 B1 6/2002 Smith
6,564,432 B1 5/2003 Kushner
6,857,167 B2 2/2005 Bishop
6,954,943 B1 10/2005 Boyko
7,028,342 B1 4/2006 Nordstrom et al.
7,065,794 B2 6/2006 Anderson
7,370,371 B2 5/2008 Butterfas et al.
7,373,696 B2 5/2008 Schoening et al.
D574,578 S 8/2008 Kreitz
7,496,972 B2 3/2009 Kreitz
7,644,489 B2 * 1/2010 Arora et al. ..... 29/607
7,930,806 B2 4/2011 Funk (Continued)

*Primary Examiner* — Andrew W Collins
(74) *Attorney, Agent, or Firm* — Greer Burns & Crain, Ltd.

(57) ABSTRACT

An improved device for restraining the two ends of a necktie is described. The device, which will be referred to as a "tieloop," consists of an elongated member having first and second ends, with first and second magnetic members positioned at those ends, respectively, enabling the ends to be coupled and uncoupled. The second magnetic member is complimentary to the first magnetic member so as to enable selective coupling between the first end and the second end. In one preferred embodiment, the first end of the tieloop is inserted into the seam of a necktie, and the second end of the tieloop couples to the first end on the opposite site of the necktie seam to selectively couple the tieloop to the necktie, thereby forming a loop.

12 Claims, 11 Drawing Sheets

(56) References Cited

U.S. PATENT DOCUMENTS

| | | | | |
|---|---|---|---|---|
| 8,056,147 | B1 | 11/2011 | Patel | |
| 8,662,682 | B2 * | 3/2014 | Gorodisher et al. | 359/519 |
| 2007/0079420 | A1 * | 4/2007 | Wilson | 2/144 |
| 2008/0060114 | A1 * | 3/2008 | Joseph | 2/145 |
| 2008/0104742 | A1 | 5/2008 | Alperin et al. | |
| 2008/0201910 | A1 | 8/2008 | Shoening et al. | |
| 2010/0115734 | A1 | 5/2010 | Wilson | |
| 2011/0057005 | A1 | 3/2011 | Mitchell | |
| 2012/0124781 | A1 | 5/2012 | Bates et al. | |

* cited by examiner

TIE LOOP

PRIORITY CLAIM

The present application claims priority back to U.S. Provisional Application Ser. No. 61/537,324, filed on Sep. 22, 2012, which is hereby incorporated by reference in its entirety.

BACKGROUND OF THE INVENTION

This invention relates to neckties and, more particularly, to a restraint system for the two ends of a necktie, but that does not couple the necktie to a shirt. A traditional necktie includes an elongated fabric material that is tied in a known manner about a user's neck, such that there are defined a pair of tails, one larger than the other, hanging in the known manner across the torso of the wearer. Unfortunately, the tails often become separated from one another, resulting in an unprofessional presentation. Most neckties include a necktie tab, which usually includes the logo of the tie manufacturer, on the inner surface of the larger tail, which tab is frequently used to receive the smaller tail in a connected and oriented presentation. However, the lengths of the tails may not enable the smaller tail to be received in the tab, especially on taller users. Or, the tails may become separated in use and require repeated re-orientation.

Various devices have been proposed in the art for restraining the tails of a necktie so as to maintain an orderly presentation. Although presumably effective for their intended purposes, many of the existing devices have disadvantages. For example, some of the devices disadvantageously require piercing the necktie, and/or employ multiple pieces that may become lost, and/or are uneasy to manipulate. Some of these previous devices require elements of the device to be visible on the outer surface of the larger tail, which may be undesirable to certain users. Further, many existing proposals for restraining the tails of a necktie require the necktie to be restrained to the accompanying shirt, which may not be desirable for the presentation.

Therefore, it would be desirable to have a necktie restraint system that requires only one piece, can be hidden from view, and does not require the necktie to be attached to a shirt in any way.

SUMMARY OF THE INVENTION

The present invention relates to a device for restraining the two ends of a necktie, and will be referred to as a "tieloop."

The tieloop according to one embodiment of the present invention consists of an elongate member having first and second ends, with first and second magnetic members coupled at the first end and second end respectively. The second magnetic member is complimentary to the first magnetic member so as to enable selective coupling of the first end to the second end. The first end of the tieloop is preferably inserted into the seam of a necktie, and the second end of the tieloop couples, via the two magnetic members, to the first end on the opposite side of the necktie seam to selectively couple the tieloop to the necktie. Once the tieloop is installed upon the tie, the user can insert the smaller tail into the tieloop, thereby attaching the smaller tail to the larger tail.

Therefore, a general object of this invention is to provide a necktie restraint to restrain the smaller tail to the larger tail of the necktie without restraining the necktie to the shirt. Other objects of the invention will become apparent for a review of the present Specification.

BRIEF DESCRIPTION OF THE DRAWINGS

FIG. 8 shows the second step of using the tieloop: coupling the left side of the tieloop (1) to the right side of the tieloop (6) with the fabric of the necktie (8) in-between.

DETAILED DESCRIPTION OF PREFERRED EMBODIMENTS

Figure 1:
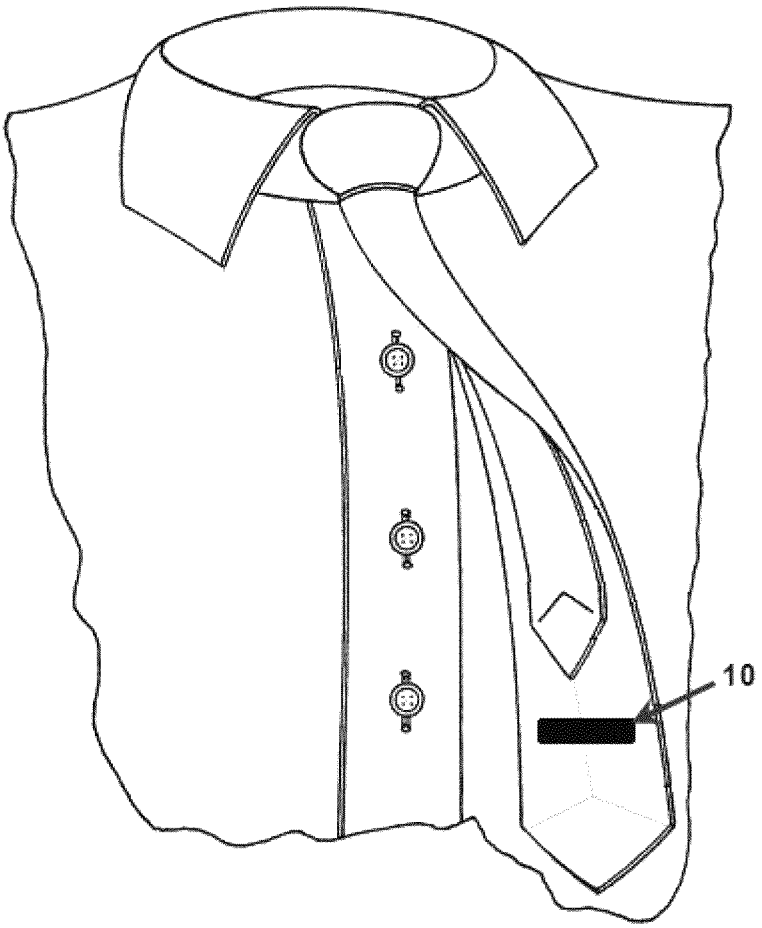
FIG. 1 is an illustration of a common problem with neckties.
Figure 2:
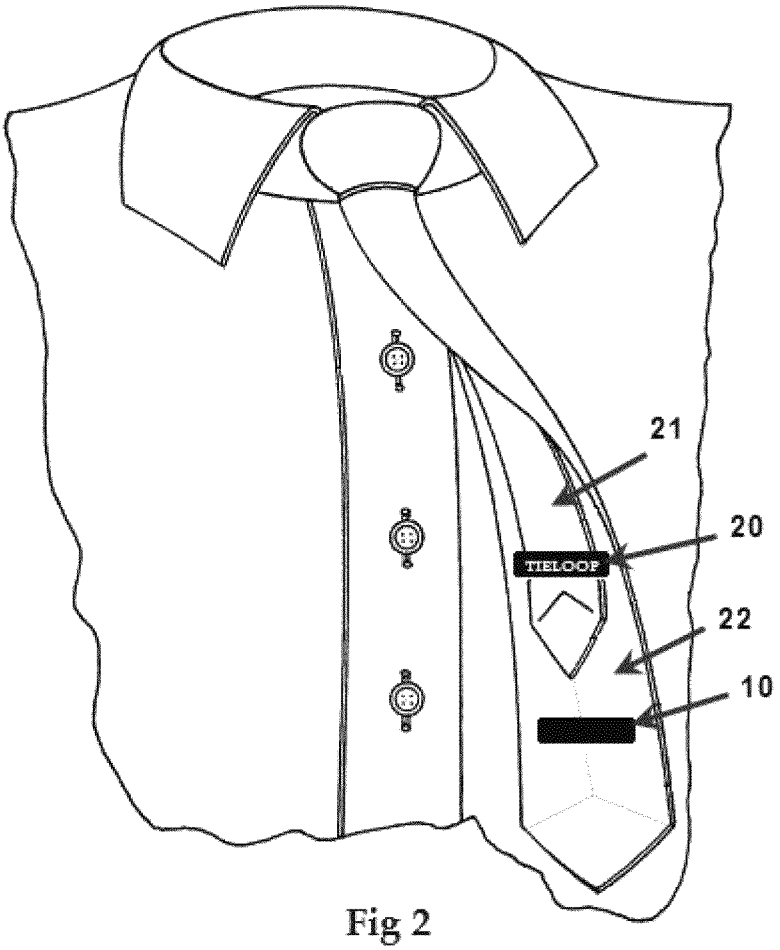
FIG. 2 is an illustration of the use of the present tieloop to resolve the problem.

Referring now to FIGS. 2-9, an embodiment of the present tieloop is shown and will be described. FIG. 2 shows an example of the tieloop in its operative position, securing a smaller tail 21 to the back side of a larger tail 22. As can be seen in FIG. 2, the tieloop 20 can be used to secure the smaller tail 21 to the rear of the larger tail 22, even when the smaller tail 21 is too short to reach the tab 10 found on a typical necktie. Further, as the tieloop includes a releasable securing means, as described below, it can be positioned at any desired location along the seam of the necktie, thereby insuring that it is in a position to receive and secure the smaller tail 21.

Figure 3A:
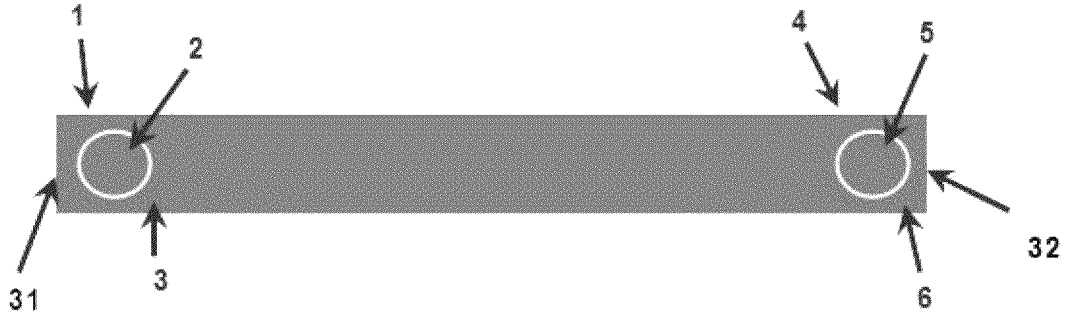
FIG. 3A is a diagram of an embodiment of the tieloop fully extended and laid flat.

Turning now to FIG. 3A, a schematic of one example of the tieloop 20 is shown in its unfolded condition, i.e., fully extended and laid flat. FIG. 3A shows how the tieloop is of a generally strip-like configuration, and includes a first end portion 31 and a second end portion 32. The first end portion 31 further includes an outside surface 1 and an inside surface 3. Similarly, the second end portion 32 includes an outside surface 4 and an inside surface 6. Also, the first end portion includes a first magnetic member 2 and the second end portion includes a second magnetic member 5. Both of the magnetic members 2 and 5 are situated in the same orientation with regard to the north/south poles (i.e., both are situated with the north poles facing up or both are situated with the south poles facing up). Although button magnets are shown in the drawings, other types of magnets are also contemplated as being suitable, as long as a mutual attraction between the magnets can be accomplished. Further, it is also contemplated that only a single magnetic member could be utilized, along with a member made of a material that is attracted to a magnet (such as iron), as long as a sufficient securing force between the magnetic member and the other member can be accomplished.

Figure 3B:
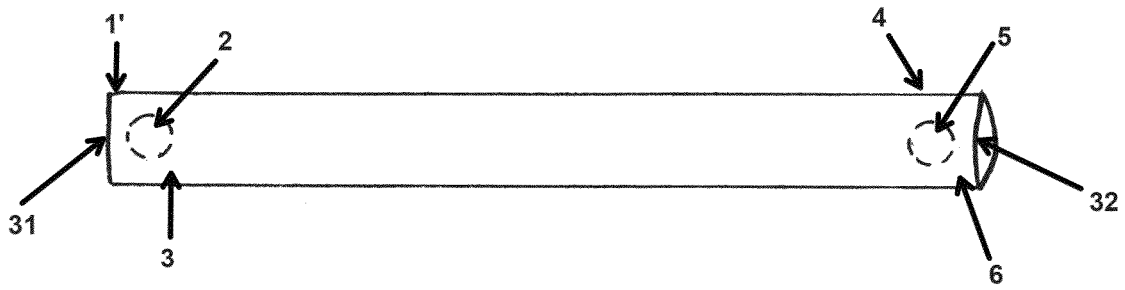
FIG. 3B is a diagram of an alternative embodiment of the tieloop fully extended and laid flat.

The magnetic members 2 and 5 can be affixed to the strip-like member in any desired fashion. For example, they can be affixed to the strip-like member using a adhesive. Alternatively, the strip-like member can be formed as a sleeve (as shown in FIG. 3B), and the magnetic members can be inserted therein in the appropriate positions, and then they can be secured in position via any desired method, such as by using adhesive or stitching, such as by providing stitching on each edge of each magnetic member to prevent it from sliding within the sleeve.

Figure 3C:
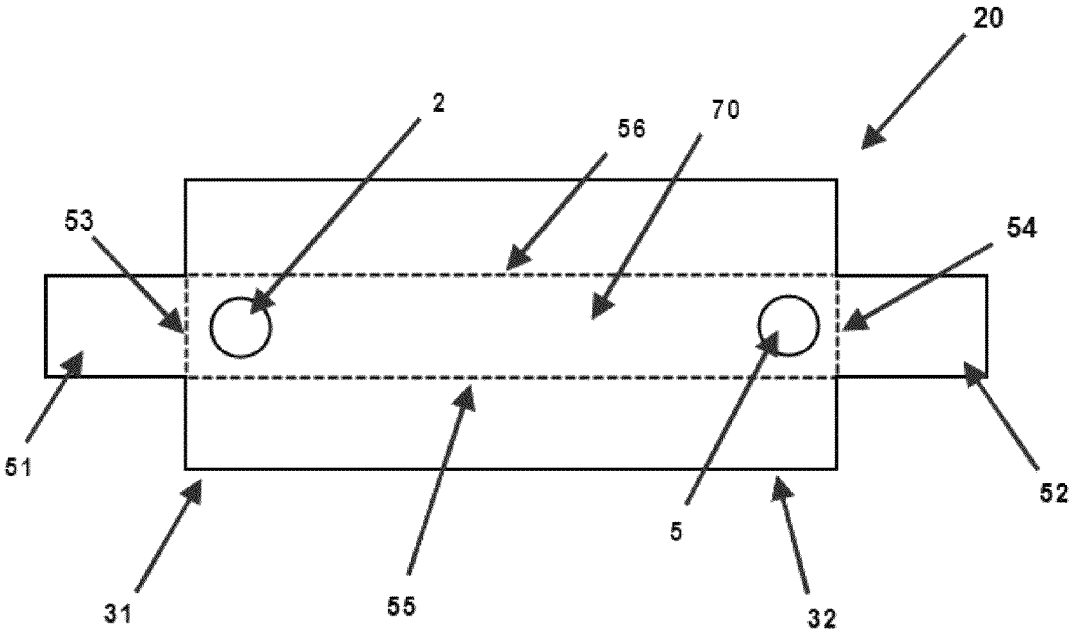
FIG. 3C is a diagram of an embodiment of the tieloop, shown prior to assembly.

FIG. 3C shows an alternative embodiment in which the tieloop 20 is formed of a piece of fabric that is assembled by being folded-over in a particular fashion. Specifically, FIG. 3C shows a flat piece of fabric that includes a first tab portion 51 on the first end portion 31 and a second tab portion 52 on the second end portion 32. Tab portions 51 and 52 may be square or rectangular, as desired, or may be of other shapes such as rectangular with an arcuate distal edge. As can be seen in FIG. 3C, magnetic members 2 and 5 are located inwardly of tab portions 51 and 52, respectively (i.e., toward the main body of the strip-like shape). Preferably, the first step of assembly is to fold tab portions 51 and 52 along dashed lines 53,54, respectively, so that tab portions 51 and 52 cover the magnetic members 2 and 5, respectively. Preferably, an adhesive is used at this point to secure tab portions 51 and 52 to the main body 70 of the strip-like shaped member. Next, one of the longitudinal side edges is folded along dashed line 55 or 56, toward the main body portion 70 of the strip-like shape. Preferably, an adhesive is provided so that the folded longitudinal side edge can be secured to the main body portion 70. Next, the other one of the longitudinal side edges is folded along the dashed line (55 or 56) toward the main body portion 70, and it is adhered thereto with an adhesive. After this step, the tieloop 20 will be in the assembled condition, such as shown in FIG. 3A.

Optionally, prior to assembly, a flexible strip of plastic or other suitable material (sized to correspond to dashed lines 53-56-54-55 of FIG. 3C) may be provided upon the main body portion 70 prior to folding, in order to give some slight rigidity to the tieloop. Such a flexible strip could also be used with any of the other embodiments. As another optional feature of any of the embodiments, the fabric used for the tieloop may be provided with a heat-activated coating on one face thereof, such as the coatings used for iron-on patches and the like. In such an embodiment, some or all of the steps in which an adhesive is applied could be omitted, and instead a heat application step would be added at the appropriate time, such as once all folding steps are completed.

Figure 4:
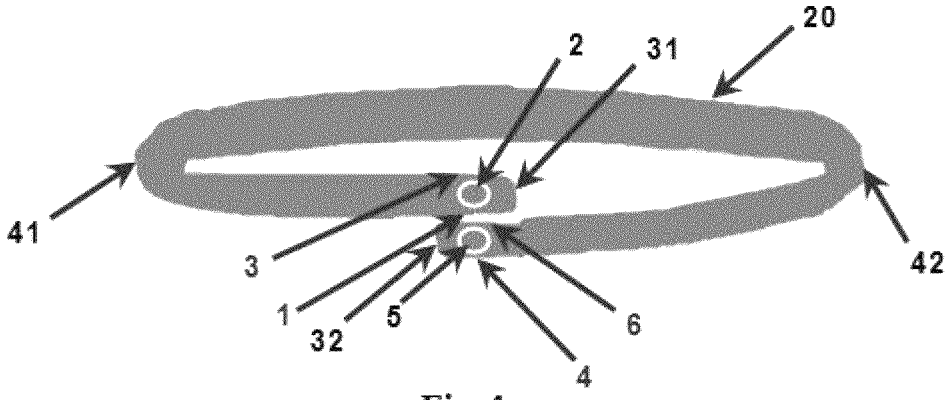
FIG. 4 is a diagram of an embodiment of the tieloop when folded into its intended shape.

Turning now to FIG. 4, an example is provided of how the tieloop 20 is folded into its intended shape for usage. As can be seen in FIG. 4, the tieloop is bent at two positions (bent portions 41 and 42) so that the ends 31 and 32 are overlapping each other. In this manner, there is a magnetic attraction between magnetic members 2 and 5, as shown by the bi-directional arrows of FIG. 5.

Figure 5:
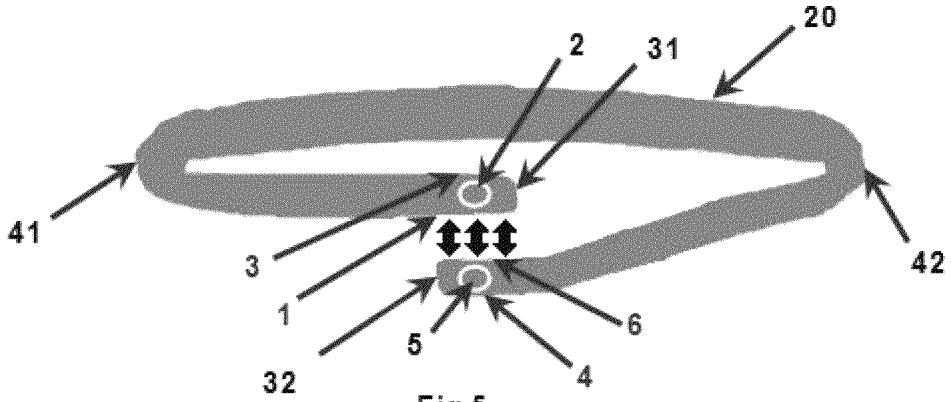
FIG. 5 shows the manner in which the magnetic members contribute to the function of the invention.
Figure 6:
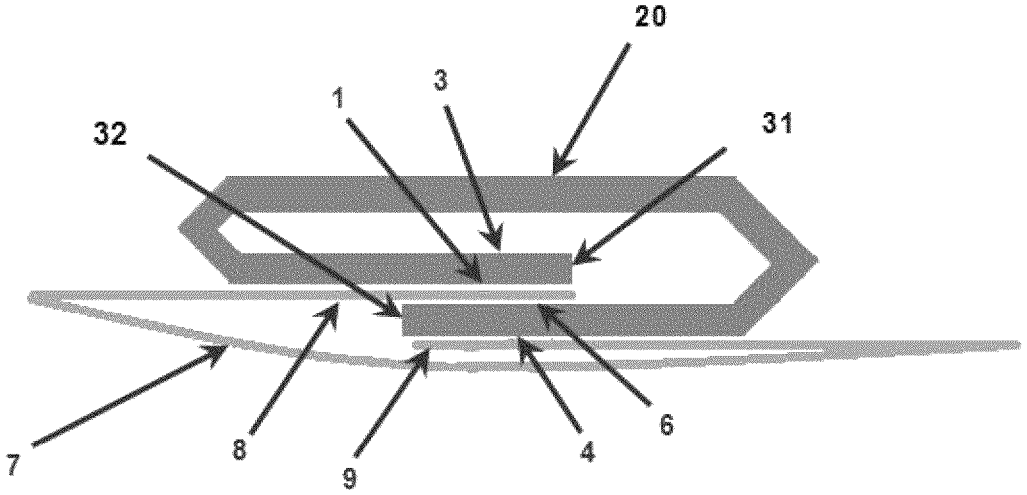
FIG. 6 shows a top-down view of a tieloop coupled to a necktie.

FIG. 6 is a top view, in partial cutaway, showing how the tieloop interacts with the seam of the tie, when it is attached to a tie. More specifically, FIG. 6 shows how the second end portion 32 is preferably inserted between the inside fabric 9 of the center seam of the necktie and the outside fabric 8 of the center seam. The first end portion 31 is positioned outside of the outside fabric 8 of the center seam of the necktie. In this manner, the magnetic force between the magnetic members 2 and 5 (as shown in FIG. 5) maintains the tieloop 20 in the desired position on the center seam of the necktie, such a configuration can be considered as a means for pinching the seam of the necktie.

Figure 7:
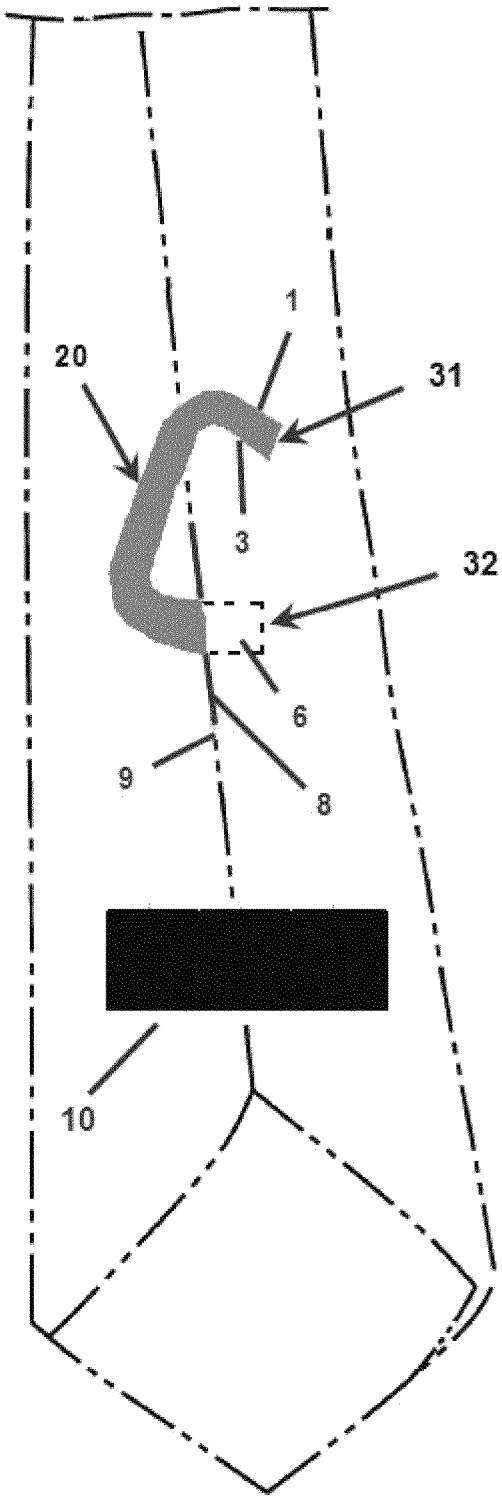
FIG. 7 shows the first step of using the tieloop: inserting one end of the tieloop inside the center seam of a necktie.
Figure 8:
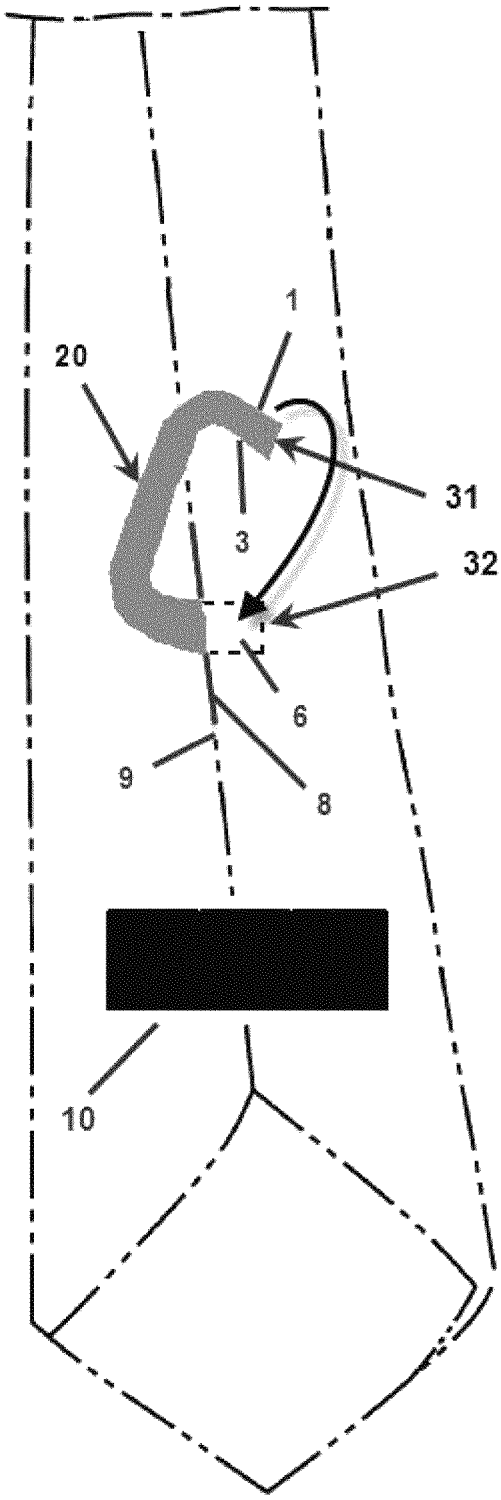
Figure 9:
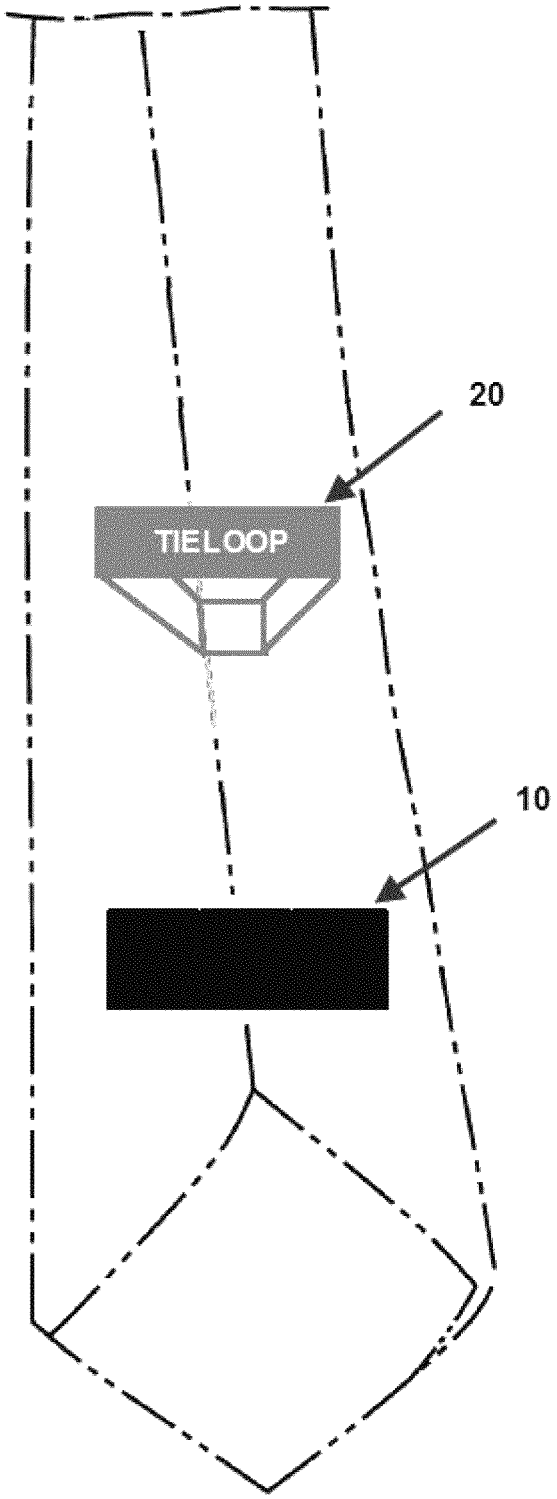
FIG. 9 represents the tieloop after it has been coupled to the necktie.

FIGS. 7 and 8 provide further explanation of how the tieloop 20 can be installed upon the center seam of a necktie. FIG. 7 shows how the second end portion 32 is inserted into the center seam of a necktie, and FIG. 8 shows how the first end portion 31 is folded over, along the arrow, so that the end portion 31 meets the end portion 32. Finally, FIG. 9 shows how it looks with the tieloop in its operative position.

In the drawings described above, the second end portion 32 has been the one inserted into the center seam of the necktie. However, as both the first end portion 31 and the second end portion 32 are essentially the same, the first end portion 31 can be the one inserted into the center seam instead of the second end portion 32.

While various embodiments of the present invention have been shown and described, it should be understood that other modifications, substitutions and alternatives may be apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A system for restraining two ends of a necktie, comprising:

a necktie with two ends, defined as a larger tail and a smaller tail when the necktie is in a knotted configuration;

wherein the necktie includes a seam running in a longitudinal direction on a rear face thereof;

a tieloop member for restraining the smaller tail to a rear face of the larger tail;

wherein the tieloop member comprises:

a strip-like member with a main body portion defined between a first end portion and a second end portion;

a first magnetic member associated with the first end portion;

a second member associated with the second end portion, wherein the second member is configured and arranged to be magnetically attracted to the first magnetic member;

a first bent portion defined between the first end portion and the main body portion; and a second bent portion defined between the second end portion and the main body portion, wherein the first and second bent portions are configured and arranged so that the first magnetic member and the second member are in an overlapping and adjacent state to define an open loop shape formed of the strip-like member, thereby enabling a magnetic attraction between the first magnetic member and the second member to maintain the open loop shape of the device, wherein the main body portion of the strip-like member comprises:

a first tab at the first end portion of the strip-like member, wherein the first tab is folded over and secured to the main body portion of the strip-like member, thereby sandwiching the first magnetic member between the first tab and the main body portion;

a second tab at the second end portion of the strip-like member, wherein the second tab is folded over and secured to the main body portion of the strip-like member, thereby sandwiching the second member between the second tab and the main body portion;

a first folded-over side portion, wherein the first folded-over side portion is folded over and secured to the main body portion of the strip-like member; and a second folded-over side portion, with a second fold line on an opposite side of a first fold line of the first folded-over side portion, wherein the second folded-over side portion is folded over and secured to the main body portion of the strip-like member, whereby said first and said second end portions of main body portion of the strip-like member each comprise four layers.

2. The system according to claim 1, wherein the second member is a magnetic member.

3. The system according to claim 1, wherein when the first magnetic member and the second member are in an overlapping and an adjacent state, a portion of said seam separates said first magnetic member from said second member.

4. A method of attaching a smaller tail to a larger tail of a knotted necktie, the method comprising:

providing a tieloop, which comprises: a strip-like member with a main body portion defined between a first end portion and a second end portion, a first magnetic member associated with the first end portion, and a second magnetic member associated with the second end portion, wherein the second member is configured and arranged to be magnetically attracted to the first magnetic member;

inserting the first end portion of the tieloop into a seam on a rear face of the larger tail of the necktie;

positioning the second end portion of the tieloop outside of the seam, but in a location adjacent to the first end portion, such that the end portion and the second end portion are in an overlapping and adjacent state to define an open loop shape formed of the strip-like member, thereby enabling a magnetic attraction between the first magnetic member and the second magnetic member to maintain the open loop shape of the device; and inserting the smaller tail into the loop shape defined by the tieloop, wherein the main body portion of the strip-like member comprises:

a first tab at the first end portion of the strip-like member, wherein the first tab is folded over and secured to the main body portion of the strip-like member, thereby sandwiching the first magnetic member between the first tab and the main body portion;

a second tab at the second end portion of the strip-like member, wherein the second tab is folded over and secured to the main body portion of the strip-like member, thereby sandwiching the second member between the second tab and the main body portion;

a first folded-over side portion, wherein the first folded-over side portion is folded over and secured to the main body portion of the strip-like member; and a second folded-over side portion, with a second fold line on an opposite side of a first fold line of the first folded-over side portion, wherein the second folded-over side portion is folded over and secured to the main body portion of the strip-like member, whereby said first and said second end portions of main body portion of the strip-like member each comprise four layers.

5. The system according to claim 2, wherein:

the first magnetic member and the second member each include a north pole and a south pole, and the north poles of both the first magnetic member and the second member face the same direction, such that when the first magnetic member and the second member are in an overlapping and adjacent state, magnetic attraction between the first magnetic member and the second member is created.

6. The system according to claim 1, wherein the second member is made of a material that is attracted to a magnet, such that when the first magnetic member and the second member are in an overlapping and adjacent state, magnetic attraction between the first magnetic member and the second member is created.

7. A system for restraining two ends of a necktie, comprising:

a necktie with two ends, defined as a larger tail and a smaller tail when the necktie is in a knotted configuration;

wherein the necktie includes a seam running in a longitudinal direction on a rear face thereof, thereby defining an inside fabric portion and an outside fabric portion;

a tieloop member for restraining the smaller tail to a rear face of the larger tail;

wherein the tieloop member comprises:

a strip-like member with a main body portion defined between a first end portion and a second end portion;

means for pinching the seam of the necktie to install the tieloop member to the necktie;

a first bent portion defined between the first end portion and the main body portion; and a second bent portion defined between the second end portion and the main body portion, wherein the first and second bent portions are configured and arranged so that when the means for pinching the seam of the necktie is applied to the necktie, the first end portion of the tieloop member contacts the inner fabric portion of the necktie and the second end portion of the tieloop member contacts the outer fabric portion of the necktie, and the first end portion and the second end portion are in an overlapping and adjacent state to define a loop-shape formed of the strip-like member, wherein said means for pinching the seam of the necktie comprises:

a first magnetic member associated with the first end portion of the strip-like member;

a second member associated with the second end portion of the strip-like member, wherein the second member is configured and arranged to be magnetically attracted to the first magnetic member.

8. The system according to claim 7, wherein the second member is a magnetic member.

9. The system according to claim 7, wherein the second member is made of a material that is attracted to a magnet, such that when the first magnetic member and the second member are in an overlapping and adjacent state, magnetic attraction between the first magnetic member and the second magnetic member is created.

10. The system according to claim 7, wherein when the first magnetic member and the second member are in an overlapping and an adjacent state, a portion of said seam of said necktie separates said first magnetic member from said second member.

11. The system according to claim 1, wherein the main body portion of the tieloop member includes a flexible strip in order to increase the rigidity of the tieloop member.

12. The system according to claim 1, wherein the main body portion of the strip-like member comprises a sleeve-like member, and further wherein said first magnetic member and said second member are both secured in position within the sleeve-like member.

* * * * *